US005904062A

United States Patent [19]

Semiatin et al.

[11] Patent Number: 5,904,062

[45] Date of Patent: May 18, 1999

[54] EQUAL CHANNEL ANGULAR EXTRUSION OF DIFFICULT-TO-WORK ALLOYS

[75] Inventors: Sheldon L. Semiatin, Dayton; David P. DeLo, Bellbrook, both of Ohio

[73] Assignee: The United States of America as represented by the Secretary of the Air Force, Washington, D.C.

[21] Appl. No.: 09/075,594

[22] Filed: May 11, 1998

[51] Int. Cl.[6] ..... B21C 23/00

[52] U.S. Cl. ..... 72/253.1; 72/272; 72/377

[58] Field of Search ..... 72/253.1, 256, 72/257, 260, 271, 272, 377, 467

[56] References Cited

U.S. PATENT DOCUMENTS

| | | | |
|---|---|---|---|
| 5,309,748 | 5/1994 | Jarrett et al. | 72/256 |
| 5,400,633 | 3/1995 | Segal et al. | 72/272 |
| 5,513,512 | 5/1996 | Segal | 72/253.1 |
| 5,600,909 | 2/1997 | Segal et al. | 72/253.1 |

OTHER PUBLICATIONS

"Working of Metals by Simple Shear Deformation Process," by Segal et al *Proceedings Fifth International Aluminum Technology Seminar*, vol. 2, 403–6 (1992).

"Plastic Working of Metals by Simple Shear," by Segal et al *Russ Metall*, vol. 1, 99–105 (1981).

*Primary Examiner*—Joseph J. Hail, III

*Attorney, Agent, or Firm*—Bobby D. Scearce; Thomas L. Kundert

[57] ABSTRACT

A method is described for producing homogeneous wrought microstructure during equal channel angular extrusion of difficult-to-work high temperature alloys that exhibit a high degree of flow softening at hot-working temperatures, wherein flow non-uniformities are minimized by imparting an increment of initial upset deformation to an alloy immediately preceding shear flow through the deformation zone.

7 Claims, 3 Drawing Sheets

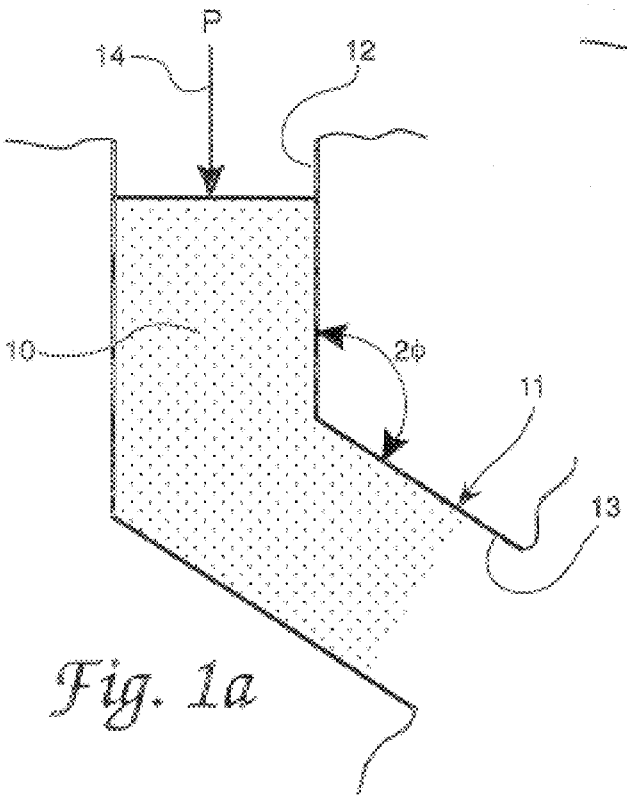
Fig. 1a
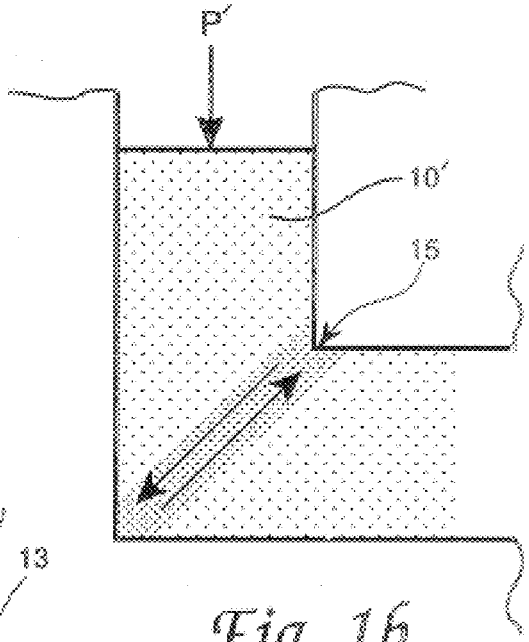
Fig. 1b
Fig. 5a
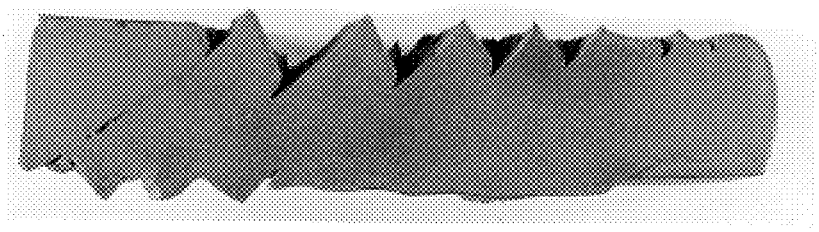
Fig. 5b
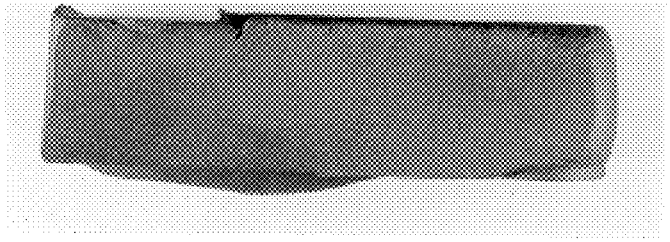

EQUAL CHANNEL ANGULAR EXTRUSION OF DIFFICULT-TO-WORK ALLOYS

RIGHTS OF THE GOVERNMENT

The invention described herein may be manufactured and used by or for the Government of the United States for all governmental purposes without the payment of any royalty.

BACKGROUND OF THE INVENTION

The present invention relates generally to methods for hot working metals and alloys for attaining selected microstructure, and more particularly to a method for producing homogeneous wrought microstructure during equal channel angular extrusion (ECAE) of difficult-to-work high temperature alloys.

Wrought processing of metals often involves hot working during initial (ingot breakdown) and intermediate fabrication steps. Typical hot working techniques include hot extrusion and various types of hot forging (cogging, pancake forging, etc.)

Conventional ECAE (see Segal et al, U.S. Pat. No. 5,400,633; Segal, "Working of Metals by Simple Shear Deformation Process," *Proceedings Fifth International Aluminum Technology Seminar*, Vol 2, 403–6 (1992); Segal et al, "Plastic Working of Metals by Simple Shear," *Russ Metall*, Vol 1, 99–105 (1981)) can be used for primary breakdown and secondary hot working of an alloy ingot. Large deformations can be imparted without change in ingot cross section, which permits small ingots to be melted to obtain a given semi-finished product size. ECAE is especially useful for materials prone to macrosegregation during casting of large ingots. Other advantages include moderate working pressures (compared to extrusion through converging conical dies) and control of crystallographic and mechanical texture during multi-pass ECAE by selective rotation of the workpiece between passes.

Although ECAE is useful for imparting large deformations to a variety of alloys, because of the simple shear nature of the deformation during ECAE, the deformation is confined to a narrow-shear zone. Thus, materials that exhibit flow softening are prone to flow localization in shear. In ECAE, formation of a shear band or shear crack results in the development of grossly nonuniform flow. Eventually, the final extruded billet exhibits a periodic series of shear bands (or shear cracks) and undeformed zones. Development of shear bands or shear cracks leads to undesirable, grossly nonuniform microstructures. Thus, the conventional (Segal et al) ECAE process may not be useful for materials that exhibit significant flow softening during hot working.

The invention solves or substantially reduces in critical importance problems with conventional ECAE by providing a method for ingot breakdown or secondary hot working via ECAE of difficult-to-work alloys that exhibit extensive flow softening, resulting in homogeneous deformation and development of uniform microstructure in alloys such as conventional titanium; nickel, iron, and cobalt base superalloys; and intermetallic alloys in the cast or wrought condition, by subjecting the alloy to an increment of upset deformation prior to shear flow in ECAE.

It is therefore a principal object of the invention to provide a hot-working method for metals and alloys.

It is another object of the invention to provide a method for hot working metals and alloys for preselected microstructure in the hot worked product.

It is a further object of the invention to provide a method for hot working difficult-to-work high temperature alloys to produce homogeneous wrought microstructure.

It is another object of the invention to provide a method for hot working high temperature aerospace alloys to produce uniform deformation and uniformly wrought microstructure by ECAE.

These and other objects of the invention will become apparent as a detailed description of representative embodiments proceeds.

SUMMARY OF THE INVENTION

In accordance with the foregoing principles and objects of the invention, a method is described for producing homogeneous wrought microstructure during ECAE of difficult-to-work high temperature alloys that exhibit a high degree of flow softening at hot-working temperatures, wherein flow non-uniformities are minimized by imparting an increment of initial upset deformation to an alloy immediately preceding shear flow through the deformation zone.

DESCRIPTION OF THE DRAWINGS

The invention will be more clearly understood from the following detailed description of representative embodiments thereof read in conjunction with the accompanying drawings wherein:

FIG. 1*a* illustrates schematically the ECAE process;

FIG. 1*b* illustrates the shear deformation zone in the ECAE process;

FIG. 5*a* shows an as extruded sample 8 of Ti-6Al-4V; and

FIG. 5*b* shows an as extruded sample R2 of Ti-6Al-4V.

DETAILED DESCRIPTION

Figure 3A:
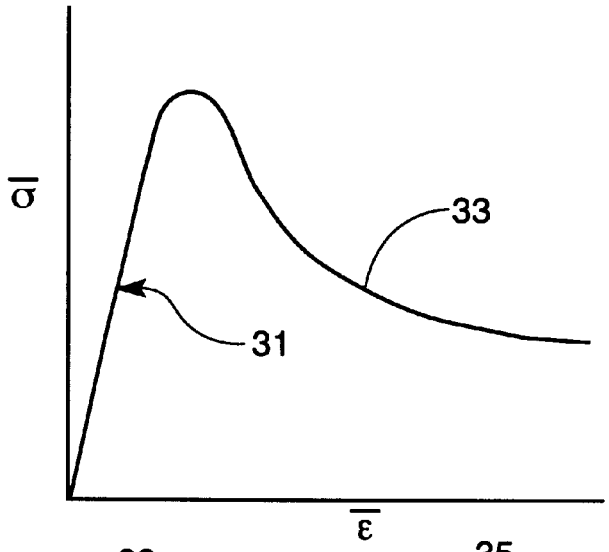
FIG. 3*a* shows $\bar{\sigma}$ versus $\bar{\epsilon}$ for a material that exhibits flow softening.

Referring now to the drawings, FIG. 1*a* illustrates schematically the ECAE process as suggested by Segal et al, supra. In the ECAE process, an ingot or prior-worked billet 10 is extruded through a channel 11 comprising two channel portions 12,13 of substantially identical cross-sectional areas having the respective centerlines thereof disposed at angle 2$\phi$. Billet 10 is typically square or rectangular in cross section and machined to provide a snug fit into entry channel portion 12. Ram 14 forces billet 10 through channel 11 under appropriate extrusion ram pressure P. The strain imposed on billet 10 is a function of channel angle; for example, a 90° channel angle imparts a strain of about 1.15. Large strains can be imposed in a given set of tooling by using multi-pass extrusions because the cross-sectional areas of channel portions 12,13 are equal.

Figure 3B:
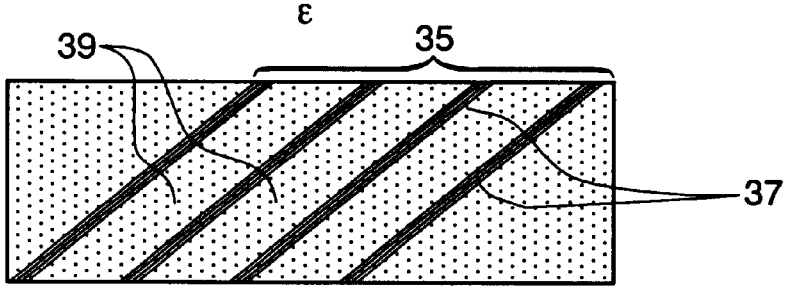
FIG. 3*b* shows schematically the macro flow pattern in ECAE for the material of FIG. 3*a;*
Figure 2A:
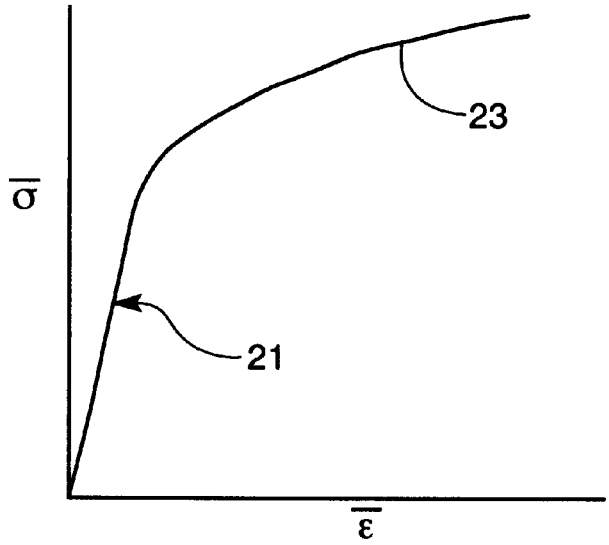
FIG. 2*a* is a schematic plot of stress $\bar{\sigma}$ versus strain $\bar{\epsilon}$ (i.e., the flow curve) for a material that exhibits strain hardening.
Figure 2B:
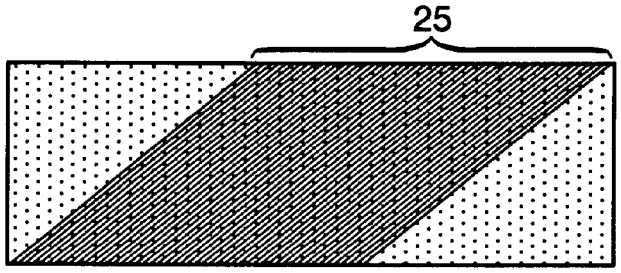
FIG. 2*b* shows schematically the macro flow pattern in ECAE for the material of FIG. 2*a;*

Referring now to FIG. 1*b*, it is seen that in the ECAE process deformation of billet 10' is confined to a narrow-shear zone 15. FIG. 2*a* shows schematically a plot 21 of stress $\bar{\sigma}$ versus strain $\bar{\epsilon}$ (i.e., the flow curve) for a material that exhibits strain hardening as at 23, and FIG. 2*b* shows schematically the macro flow pattern 25 for the FIG. 2*a* material after extrusion via ECAB. FIG. 3*a* shows schematically a plot 31 of stress versus strain for a material that exhibits flow softening as at 33, and FIG. 3*b* shows schematically the corresponding macro flow pattern 35 for the FIG. 3*a* material after ECAE. Materials that exhibit strain hardening (increasing flow stress with increasing strain, FIG. 2*a*) are generally capable of supporting such shear deformation without the formation of localized shear bands or shear fractures (FIG. 2*b*). In contrast, materials that exhibit strain (flow) softening (FIG. 3*a*) are prone to these types of flow localization (FIG. 3*b*) or fracture; such flow softening may result from microstructural changes during deformation (e.g., globularization of lamellar microstructure, recrystallization, texture changes, etc.) or deformation-induced heating. In the majority of cases, the rate of flow softening is greatest at low strains and decreases rapidly to a fairly low level by the time strains of the order of 0.5 are reached. Once a shear band or shear fracture develops, the material on either side ceases deformation. In the ECAE process, the formation of a shear band or shear crack results in the development of grossly nonuniform flow because a given region containing highly sheared material and the material adjacent to it with limited deformation must be moved completely through the die before "incoming" undeformed material can be subjected to deformation. However, the subsequent undeformed material will also be subject to flow localization. Eventually, the final extruded billet will exhibit a periodic series of highly deformed shear bands 37 (or shear cracks) and zones 39 of limited deformation (FIG. 3*b*).

The relative tendency for flow localization within a flow softening material may be assessed from the magnitude of the flow localization, or alpha, parameter, whose value depends on material properties and the specific deformation mode. For a material undergoing simple shear deformation, the pertinent alpha parameter, $\alpha_{SS}$, is defined by, $$\alpha_{SS}=-[(1/\bar{\sigma})d\bar{\sigma}/d\bar{\epsilon}]/m=\gamma/m \quad (1)$$

where $\bar{\sigma}(\bar{\epsilon})$ denotes the flow stress $\bar{\sigma}$ as a function of strain $\bar{\epsilon}$ (at a given strain rate $\dot{\bar{\epsilon}}$), and m is the strain-rate sensitivity coefficient $(\partial\log\bar{\sigma}/\partial\log\dot{\bar{\epsilon}})|_{\epsilon,T}$ where T denotes temperature. Although a necessary condition for flow localization in shear is $\alpha_{SS}\geqq 0$, it has been found generally that values of $\alpha_{SS}$ equal to or greater than about 5 are required to give rise to noticeable shear localization. (See S. L. Semiatin and J. J. Jonas, *Formability and Workability of Metals*, American Society for Metals, Metals Park, Ohio, 1984).

A related, but slightly different, flow localization/alpha parameter, $\alpha_u$, can be defined for an uniaxial upsetting mode of deformation, viz.:

$$\alpha_u=\{[-(1/\bar{\sigma})(d\bar{\sigma}/d\bar{\epsilon})]-1\}/m=(\gamma-1)/m \quad (2)$$

In upsetting, flow localization occurs in the form of nonuniform bulging. As for shear deformation, a necessary condition for flow localization during upsetting is $\alpha_u\geqq 0$; however, it has likewise been found that values of $\alpha_u\geqq 5$ are required to produce noticeable flow localization during upsetting.

In accordance with a governing principle of the invention, it is noted that for given material flow characteristics ($\bar{\sigma}=\bar{\sigma}(\bar{\epsilon})$), comparison of Eqs (1) and (2) shows that the tendency for flow localization is less in upsetting than in simple shear because $(\gamma-1)/m<\gamma/m$. It should also be noted that difficult-to-work metals typically exhibit a decreasing rate of flow softening with increasing strain, i.e., $\gamma$ decreases with strain. According to the invention, an increment of upsetting-type deformation is imparted to the workpiece prior to being subjected to the shear deformation in the shear zone located at the intersection of the two sections of the ECAE channel. By this means, material flow at low strains occurs via an upsetting mode, which is more stable than shear deformation, and flow at higher strains, at which the rate of flow softening and hence flow localization tendency is less, can be conducted in simple shear without giving rise to shear localization. The easiest way to accomplish such deformation is with a preform of cross-sectional area less than the channel. After insertion into the channel, such a preform will upset prior to passing into the shear zone. For example, if a round bar of diameter d is placed into a channel of square cross-section sxs, the upset strain required to fill the channel is $\ln(4s^2/\pi d^2)=0.24+2\ln(s/d)$. For d=0.9s, for example, the workpiece will upset to a strain of 0.45.

Figure 4A:
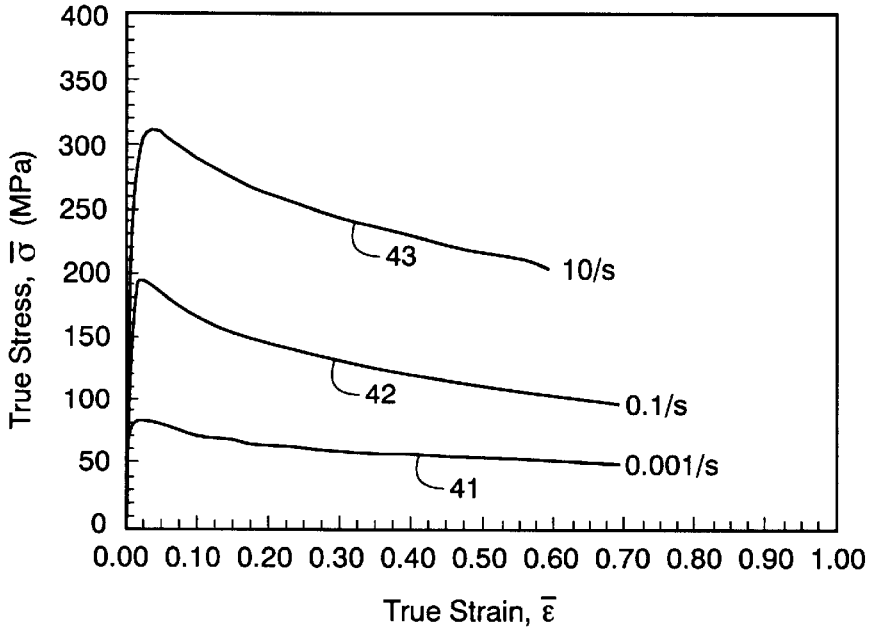
FIG. 4*a* shows $\bar{\sigma}$ versus $\bar{\epsilon}$ flow curves for Ti-6Al-4V at 1650° F.
Figure 4B:
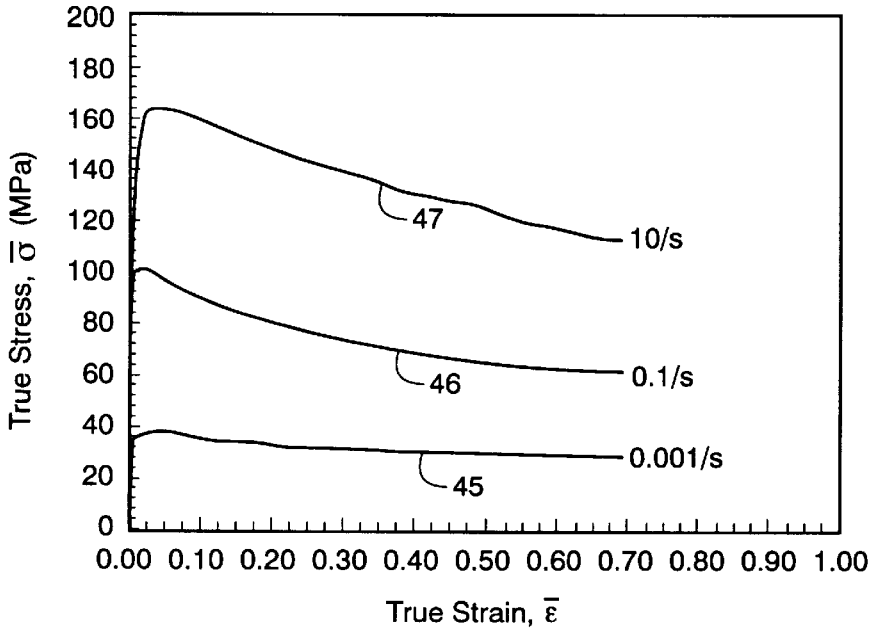
FIG. 4*b* shows $\bar{\sigma}$ versus $\bar{\epsilon}$ flow curves for Ti-6AI-4V at 1750° F.

Extrusions in demonstration of the invention were made on samples of the titanium alloy Ti-6Al-4V. FIGS. 4*a* and 4*b* show flow curves for Ti-6Al-4V having a colony-type nicrostructure of lamellar alpha and beta, which microstructure is typical for the alloy in the ingot cast state or after beta hot-working or beta annealing. FIG. 4*a* shows $\bar{\sigma}$ versus $\bar{\epsilon}$ (flow) curves 41,42,43 at respective strain rates of 0.001, 0.1 and 10.0 $s^{-1}$ for Ti-6Al-4V at 1650° F. FIG. 4*b* shows $\bar{\sigma}$ versus $\bar{\epsilon}$ (flow) curves 45,46,47 at respective strain rates of 0.001, 0.1 and 10.0 $s^{-1}$ for Ti-6Al-4V at 1750° F. Conventional metalworking operations are typically conducted at strain rates between 0.1 and 10.0 $s^{-1}$. All of the flow curves exhibit a maximum at very low strains (less than about 0.05) followed by extensive flow softening (i.e., decreasing stress with increasing strain). From these flow curves, the flow softening rates $\gamma$, strain-rate sensitivity coefficients m, and alpha parameters were determined for strain levels of 0.10 and 0.50, and are shown in TABLE I. For each combination of temperature and strain rate, it is seen that the magnitude of $\gamma$ decreases with increasing strain. Similarly, the values of both flow localization parameters, $\alpha_{SS}$ and $\alpha_u$, decrease with strain. Furthermore, the data reveal that the magnitude of $\alpha_{SS}$ is significantly greater than 5 at strains of 0.10 and less than 5 at strains of 0.50 for each temperature-strain rate combination. On the other hand, $\alpha_u$ is less than 5 (and in many cases less than zero) at both strain levels. These measurements show that upsetting deformation would be uniform at all strain levels, but that marked shear localization tendencies might be expected at low deformations (≈0.10 strain) but not at higher strains (0.50 strain). Thus, metal flow through the shear zone of an ECAE die would be nonuniform if not preceded by an initial increment of upset deformation of the order of 0.3 to 0.5, i.e., if attempts were made to extrude a square billet which would fit snugly into the ECAE die.

Trial ECAE extrusions were made on Ti-6Al-4V billets with the same structure as that of the material used to obtain the FIGS. 4*a*,4*b* flow curves. The results are summarized in TABLE II. The extrusions were made at several different temperatures at which substantial flow softening occurs. The preforms that were rectangular in cross section upset only a small amount ($\bar{\epsilon}=\ln(1.025\times1.000/0.954\times0.924)=0.15$) prior to extrusion. This small strain corresponds to that at which the flow softening rate and $\alpha_{SS}$, are still very high. These billets exhibited moderate to severe shear localization during extrusion as shown in FIG. 5*a*. By contrast, round preforms that had an initial diameter of 0.976 inch upset a substantially larger amount ($\bar{\epsilon}=\ln(1.025\times1.000/\pi\times0.976^2\times0.25)=0.315$) prior to extrusion. This latter strain corresponds to one at which the flow softening rate and hence (cxs has decreased substantially. These billets exhibited uniform deformation during extrusion as shown in FIG. 5*b*. The round preform with an initial diameter of 0.839 inch buckled prior to extrusion, illustrating limitations on the degree of looseness that may be accommodated.

Parameters used for the Ti-6Al-4V extrusions listed in TABLE II are only representative of materials and parameters useful in practicing the invention, and are not to be construed as only those which may be used successfully in the method of the invention. Other parameters depending on overall workpiece size, material flow properties, and available equipment may be readily ascertained by one skilled in the applicable metalworking art guided by these teachings. Workpiece material may be cast ingot or prior worked billet, and the alloy may be selected from any of the conventional titanium alloys; nickel, iron, or cobalt-base superalloys; intermetallics; titanium, nickel, or iron aluminide alloys; refractory-metal alloys; low, medium, or high-alloy steels; austenitic, ferritic or martensitic stainless steels, etc, in the cast or wrought condition. Workpieces ranging from about 1 to 60 inches in cross-section may be processed and may have a round, prismatic or other shape whose cross-sectional area has been selected relative to that of the ECAE container to impose an upset reduction corresponding to a strain between 0.30 to 0.60, the exact level depending on the specific flow characteristics of the selected alloy. Various press types may be used including hydraulic and mechanical presses. Imposed strain rates will generally be in the range of 0.05 to 10 $s^{-1}$ with the optimal range between 0.05 and 1 $s^{-1}$ the lower limit being set by die chill considerations. The ECAE tooling may have various die angles ($2\phi$) ranging from 75° to 135°, but most usually in the range from 90° to 110°. The upset reduction and die angle may be chosen based on the specific flow characteristics of the workpiece material.

The entire teachings of all references cited herein are incorporated by reference herein.

The invention therefore provides a method for producing homogeneous wrought microstructure during ECAE of difficult-to-work high temperature alloys that exhibit extensive flow softening. It is understood that modifications to the invention may be made as might occur to one with skill in the field of the invention within the scope of the appended claims. All embodiments contemplated hereunder that achieve the objects of the invention have therefore not been shown in complete detail. Other embodiments may be developed without departing from the spirit of the invention or from the scope of the appended claims.

TABLE I

| Temperature (° F.) | Strain Rate ($s^{-1}$) | Strain | $\gamma$ | m | $\alpha_{ss}$ | $\alpha_u$ |
|---|---|---|---|---|---|---|
| 1650 | 0.1 | 0.10 | 1.469 | 0.143 | 10.2 | 3.2 |
| 1650 | 0.1 | 0.50 | 0.666 | 0.143 | 4.6 | <0 |
| 1650 | 10.0 | 0.10 | 1.182 | 0.105 | 11.3 | 1.7 |
| 1650 | 10.0 | 0.50 | 0.501 | 0.105 | 4.8 | <0 |
| 1750 | 0.1 | 0.10 | 1.263 | 0.165 | 7.7 | 1.6 |
| 1750 | 0.1 | 0.50 | 0.420 | 0.165 | 2.5 | <0 |
| 1750 | 10.0 | 0.10 | 0.698 | 0.106 | 6.6 | <0 |
| 1750 | 10.0 | 0.50 | 0.496 | 0.106 | 4.7 | <0 |

TABLE II*

| Sample | Preform Cross-Section | Preform Dimensions‡ (inch) | Preheat Temp (° F.) | Ram Speed (in/s) | Results |
|---|---|---|---|---|---|
| 1 | Rectangular | 0.954 × 0.924 | 1778 | 1.0 | Moderate shear localization |
| 2 | Rectangular | 0.954 × 0.924 | 1805 | 0.5 | Moderate shear localization |
| 3 | Rectangular | 0.954 × 0.924 | 1805 | 1.0 | Moderate shear localization |
| 4 | Rectangular | 0.954 × 0.924 | 1805 | 1.0 | Moderate shear localization |
| 5 | Rectangular | 0.954 × 0.924 | 1652 | 1.0 | Severe shear localization |
| 7 | Rectangular | 0.924 × 0.954 | 1805 | 1.0 | Limited shear localization |
| 8 | Rectangular | 0.924 × 0.954 | 1652 | 1.0 | Severe shear localization |
| R1 | Round | 0.976$\phi$ | 1805 | 1.0 | Uniform metal flow |
| R2 | Round | 0.976$\phi$ | 1652 | 1.0 | Uniform metal flow |
| R3 | Round | 0.839$\phi$ | 1805 | 1.0 | Buckled/nonuniform flow |

*All preforms had a transformed (colony) microstructure and were lubricated with glass prior to preheating/extrusion. Extrusion channel was 1.025 × 1.00 inch in cross-section and had a die angle ($2\phi$) equal to 90° in all cases.
‡Dimensions correspond to those at the preheat temperature. All samples had a length of 5.1 in.

We claim:

1. In a method for extruding metals and alloys by equal channel angular extrusion, an improvement for producing homogeneous wrought microstructure in difficult-to-work high temperature alloys, comprising the steps of:

(a) providing an extrusion channel having an entry channel portion and an exit channel portion, said entry channel portion and said exit channel portion having substantially identical cross-sectional areas and having the respective centerlines thereof disposed at a preselected angle, said extrusion channel defining a shear zone at the intersection of said entry channel portion and said exit channel portion;

(b) providing a billet of alloy material for extrusion through said extrusion channel, said billet sized to define a loose fit within said entry channel portion of said extrusion channel; and (c) extruding said billet through said extrusion channel under preselected strain and strain rate whereby an increment of upsetting-type deformation is imparted to said billet near said shear zone.

2. The method of claim 1 wherein said alloy material is selected from the group consisting of titanium alloys, nickel, iron and cobalt-base superalloys and intermetallics, titanium, nickel and iron aluminide alloys, refractory-metal alloys, steels, and austenitic, ferritic and martensitic stainless steels.

3. The method of claim 1 wherein said preselected strain is in the range of from 0.30 to 0.60.

4. The method of claim 1 wherein said strain rate is in the range of from 0.05 to 10 $s^{-1}$.

5. The method of claim 4 wherein said strain rate is in the range of from 0.05 and 1 $s^{-1}$.

6. The method of claim 1 wherein said preselected angle is in the range of from 75° to 135°.

7. The method of claim 6 wherein said angle is in the range of from 90° to 110°.

* * * * *